US011434658B2

(12) United States Patent
Wind et al.

(10) Patent No.: US 11,434,658 B2
(45) Date of Patent: Sep. 6, 2022

(54) LOCK WITH MOVABLE KNOB

(71) Applicant: ZEPHYR LOCK, LLC, Newtown, CT (US)

(72) Inventors: Patrick Wind, Darien, CT (US); Douglas Walker, Middlebury, CT (US)

(73) Assignee: ZEPHYR LOCK, LLC, Newtown, CT (US)

( * ) Notice: Subject to any disclaimer, the term of this patent is extended or adjusted under 35 U.S.C. 154(b) by 60 days.

(21) Appl. No.: 16/847,195

(22) Filed: Apr. 13, 2020

(65) Prior Publication Data

US 2020/0240172 A1 Jul. 30, 2020

Related U.S. Application Data

(63) Continuation of application No. 15/885,127, filed on Jan. 31, 2018, now Pat. No. 10,619,378.

(60) Provisional application No. 62/452,874, filed on Jan. 31, 2017.

(51) Int. Cl.

| | |
|---|---|
| ***E05B 1/00*** | (2006.01) |
| ***E05B 13/10*** | (2006.01) |
| ***E05B 37/00*** | (2006.01) |
| ***E05B 17/04*** | (2006.01) |
| ***E05B 17/00*** | (2006.01) |
| ***E05B 5/02*** | (2006.01) |
| ***E05B 47/00*** | (2006.01) |

(52) U.S. Cl.

CPC ..... *E05B 1/0092* (2013.01); *E05B 1/0007* (2013.01); *E05B 1/0015* (2013.01); *E05B 5/003* (2013.01); *E05B 13/103* (2013.01); *E05B 17/0041* (2013.01); *E05B 17/042* (2013.01); *E05B 37/0068* (2013.01); *E05B 47/0012* (2013.01); *E05B 2001/0023* (2013.01); *E05B 2047/002* (2013.01); *E05B 2047/0021* (2013.01); *E05B 2047/0086* (2013.01); *E05B 2047/0094* (2013.01)

(58) Field of Classification Search

CPC .... E05B 1/0092; E05B 1/0007; E05B 1/0015; E05B 5/003; E05B 13/103; E05B 17/0041; E05B 17/042; E05B 37/0068; E05B 47/0012; E05B 2001/0023; E05B 2047/002; E05B 2047/0021; E05B 2047/0086; E05B 2047/0094

USPC ..... 70/208, 210, 213, 224, 190, 277, 279.1, 70/280; 16/412

See application file for complete search history.

(56) References Cited

U.S. PATENT DOCUMENTS

| | | | |
|---|---|---|---|
| 1,944,642 | A | 1/1934 | Holbrook |
| 2,105,350 | A | 1/1938 | Gerald |
| 3,834,198 | A | 9/1974 | Wiezer |
| 4,167,104 | A | 9/1979 | Bond |
| 5,460,248 | A | 10/1995 | Korb et al. |
| 5,813,257 | A | 9/1998 | Claghorn et al. |
| 6,474,119 | B1 | 11/2002 | Halvorson et al. |
| 6,496,101 | B1 | 12/2002 | Stillwagon |
| 6,867,685 | B1 | 3/2005 | Stillwagon |
| 6,967,562 | B2 | 11/2005 | Menard et al. |

(Continued)

*Primary Examiner* — Suzanne L Barrett

(74) *Attorney, Agent, or Firm* — Cantor Colburn LLP

(57) ABSTRACT

A lock including: a retractable knob; and a knob release mechanism for retaining the retractable knob in a retracted position, the knob release mechanism retains the retractable knob in the retracted position until a motor of the knob release mechanism is actuated by an input provided to a keypad located on a surface of the lock.

18 Claims, 10 Drawing Sheets

(56) References Cited

U.S. PATENT DOCUMENTS

| | | | | |
|---|---|---|---|---|
| 7,296,447 | B2 | 11/2007 | Priest et al. | |
| 8,176,761 | B2 | 5/2012 | Sorensen et al. | |
| 8,490,445 | B2 | 7/2013 | Chiou et al. | |
| 10,269,202 | B2 | 4/2019 | Denison | |
| 10,619,378 | B2 * | 4/2020 | Wind | E05B 5/003 |
| 2002/0013980 | A1 | 2/2002 | Bella et al. | |
| 2008/0163462 | A1 | 7/2008 | King | |
| 2011/0148575 | A1 * | 6/2011 | Sobecki | E05B 17/10 292/336.3 |
| 2012/0049544 | A1 | 3/2012 | Kwon | |
| 2012/0073338 | A1 | 3/2012 | Mohla | |
| 2015/0191936 | A1 | 7/2015 | Chen | |
| 2018/0216364 | A1 | 8/2018 | Wind et al. | |

* cited by examiner

LOCK WITH MOVABLE KNOB

CROSS REFERENCE TO RELATED APPLICATIONS

This application is a continuation of U.S. patent application Ser. No. 15/885,127 filed on Jan. 31, 2018, which claims priority to U.S. Provisional Patent Application Ser. No. 62/452,874, filed on Jan. 31, 2017, the contents each of which are incorporated herein by reference thereto.

BACKGROUND

Exemplary embodiments of the present disclosure relate generally to locks for use with enclosures including but not limited to lockers.

Locks are used to secure or lock the door of lockers, cabinets, toolboxes, desks, and other such enclosures. In some applications, an associated knob is used manipulate or turn components of the lock or components secured thereto in order to open a door of the enclosure. Such knobs may be susceptible to damage.

Accordingly, it is desirable to provide a lock with a knob that is protected when not in use.

BRIEF DESCRIPTION

Disclosed is a lock, including: a retractable knob; and a knob release mechanism for retaining the retractable knob in a retracted position, wherein the knob release mechanism includes a damper with a gear that is slidably received within a set of grooves located in the retractable knob, and wherein the gear prevents rotation of the retractable knob unless it is in an extended position.

In addition to one or more of the features described above, or as an alternative to any of the foregoing embodiments, the knob release mechanism may further include a primary arm and a secondary arm, wherein the secondary arm is configured to retain the retractable knob in the retracted position.

In addition to one or more of the features described above, or as an alternative to any of the foregoing embodiments, the knob release mechanism may further include a motor having a worm, wherein the motor when actuated pivots the secondary arm into the second position.

In addition to one or more of the features described above, or as an alternative to any of the foregoing embodiments, the worm may pivot the primary arm by engaging teeth of the primary arm.

In addition to one or more of the features described above, or as an alternative to any of the foregoing embodiments, the lock may further include a keypad for actuating the motor.

In addition to one or more of the features described above, or as an alternative to any of the foregoing embodiments, the lock may further include a touchscreen for actuating the motor.

In addition to one or more of the features described above, or as an alternative to any of the foregoing embodiments, the knob release mechanism may further include a primary arm pivotally mounted to the knob release mechanism for movement between a first position and a second position and a secondary arm pivotally mounted to the knob release mechanism for movement between a first position and a second position, wherein the secondary arm has a hook portion that is received in a cavity of the retractable knob when it is in the retracted position and the secondary arm is in the first position.

In addition to one or more of the features described above, or as an alternative to any of the foregoing embodiments, the knob release mechanism may further include a primary arm and a secondary arm, wherein the secondary arm is configured to retain the retractable knob in the retracted position and the primary arm has a protrusion configured to engage a slot of the secondary arm.

In addition to one or more of the features described above, or as an alternative to any of the foregoing embodiments, the retractable knob may be spring biased into an extended position.

In addition to one or more of the features described above, or as an alternative to any of the foregoing embodiments, the set of grooves may be located in an exterior surface of the retractable knob.

In yet another embodiment, a method for releasing a retractable knob of a lock is provided. The method including the steps of: spring biasing the retractable knob into an extended position; and retaining the retractable knob in a retracted position by a knob release mechanism; and damping movement of the retractable knob from the retracted position to the extended position with a damper.

In addition to one or more of the features described above, or as an alternative to any of the foregoing embodiments, the damper may further include a gear that is slidably received within a set of grooves located in the retractable knob.

In addition to one or more of the features described above, or as an alternative to any of the foregoing embodiments, the method may further include the step of preventing rotation of the retractable knob unless it is in an extended position.

In addition to one or more of the features described above, or as an alternative to any of the foregoing embodiments, rotation of the retractable knob may be prevented by the gear.

In addition to one or more of the features described above, or as an alternative to any of the foregoing embodiments, the set of grooves may further include a first set of grooves and a second set of grooves, the second set of grooves having a greater length than the first set of grooves, wherein the first set of grooves are closer to a forward surface of the retractable knob.

In addition to one or more of the features described above, or as an alternative to any of the foregoing embodiments, the knob release mechanism may further include a primary arm pivotally mounted to the knob release mechanism for movement between a first position and a second position and a secondary arm pivotally mounted to the knob release mechanism for movement between a first position and a second position, wherein the secondary arm is configured to retain the retractable knob in the retracted position when it is in the first position.

In yet another embodiment, a lock system is provided. The lock system having: a lock, including: a retractable knob; a knob release mechanism for retaining the retractable knob in a retracted position, wherein the knob release mechanism includes a damper with a gear that is slidably received within a set of grooves located in the retractable knob, and wherein the gear prevents rotation of the retractable knob unless it is in an extended position; a receiver configured to receive wireless transmissions and wherein the receiver is in operable communication with a motor for actuating the knob release mechanism so that the retractable knob can be moved into the extended position; and a wireless key that communicates wirelessly with the receiver.

In addition to one or more of the features described above, or as an alternative to any of the foregoing embodiments, the lock system may further include a microprocessor in operable communication with the motor and the receiver.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1A:
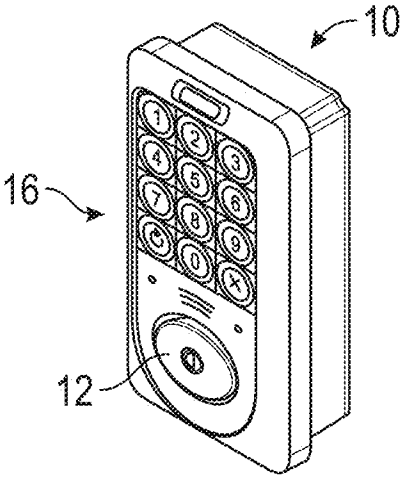
FIG. 1A is a perspective view of a lock according to one embodiment in a first position.
Figure 1B:
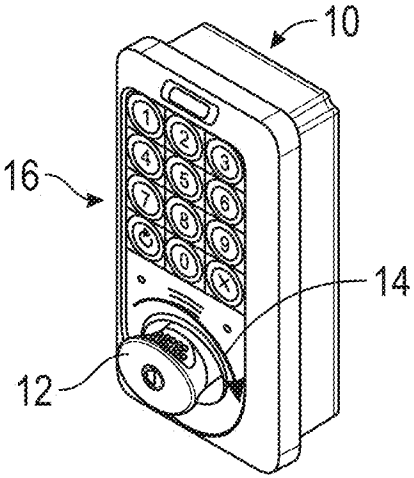
FIG. 1B is a perspective view of the lock of FIG. 1A in a second position.
Figure 1C:
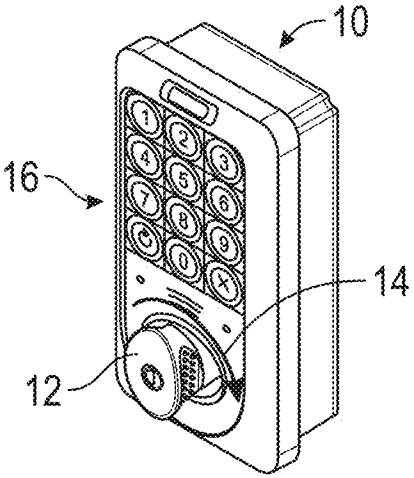
FIG. 1C is a perspective view of the lock of FIG. 1A in a third position.

Referring now to FIG. 1A is a perspective view of a lock 10 according to one embodiment of the present disclosure is illustrated in a first position, wherein a retractable knob 12 is shown in a first or retracted position. In FIG. 1B the retractable knob 12 is in a second position or extended position. In FIG. 1C the retractable knob 12 is rotated in the direction of arrow 14 to a rotated or third position from the second position. Rotation of the retractable knob from the second position to the third position will cause movement of a component secured to the lock 10 which will unlock a latch (not shown). The lock 10 illustrated in FIGS. 1A-1C is operated by a keypad 16.

Figure 2A:
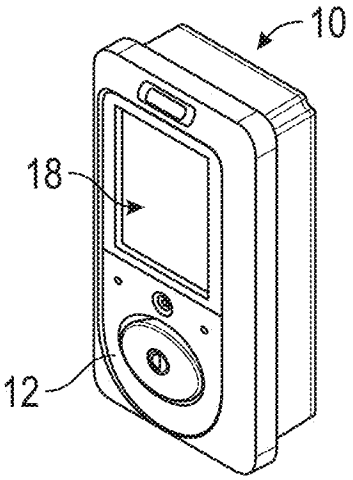
FIG. 2A is a perspective view of a lock according to another embodiment in a first position.
Figure 2B:
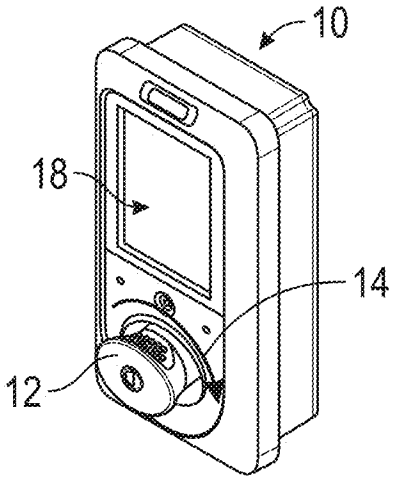
FIG. 2B is a perspective view of the lock of FIG. 2A in a second position.
Figure 2C:
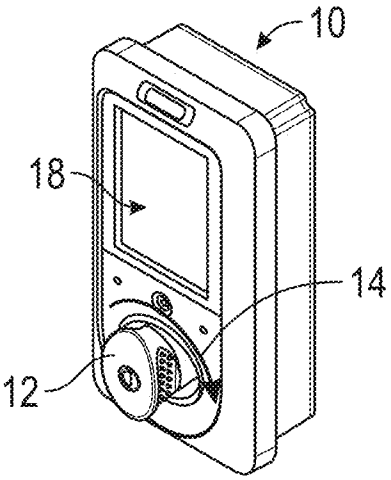
FIG. 2C is a perspective view of the lock of FIG. 2A in a third position.

Referring now to FIG. 2A is a perspective view of a lock 10 according to another embodiment of the present disclosure is illustrated in a first position, wherein the retractable knob 12 is shown in a first or retracted position. In FIG. 2B the retractable knob 12 is in the second position or extended position. In FIG. 2C the retractable knob 12 is rotated in the direction of arrow 14 to the rotated or third position from the second position. Rotation of the retractable knob from the second position to the third position will cause movement of a component secured to the lock 10 which will unlock a latch (not shown). The lock 10 illustrated in FIGS. 2A-2C is operated by a touch screen 18.

In operation the lock 10 is unlocked by providing the proper combination to the lock 10 via the keypad 16 or touch screen 18. Once this combination is provided a motor is energized and the knob 12 of the lock 10 is released from its first or retracted position so that it can move to its second position and thus be rotated to its third position thereby unlocking the enclosure the lock 10 is associated with.

Figure 3:
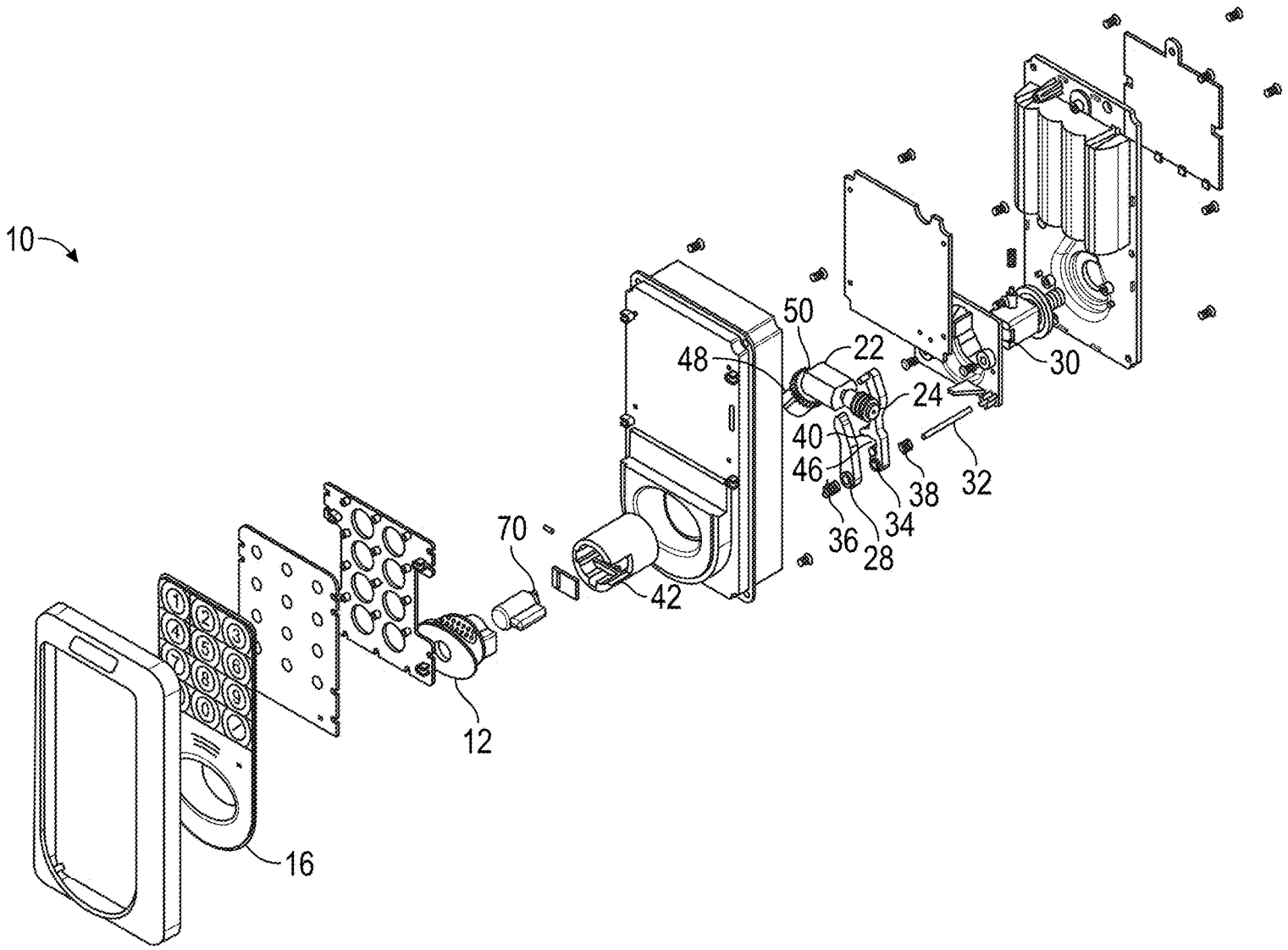
FIG. 3 is an exploded perspective view of the lock of FIG. 1A.

FIG. 3 is an exploded perspective view of the lock 10 of FIGS. 1A-1C.

Figure 4:
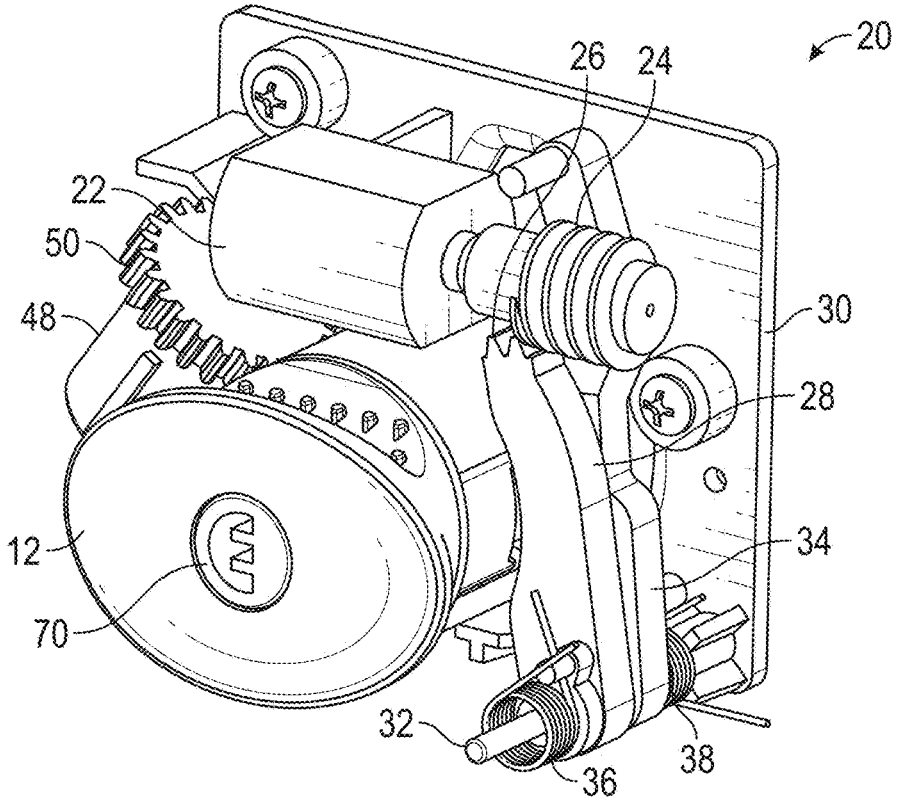
FIGS. 4 and 5 are perspective views of a knob and knob release mechanism in a locked and fully retracted knob position corresponding to a first position.

Referring now to FIGS. 4-18 operation of a knob release mechanism 20 of the lock 10 is illustrated. The knob release mechanism 20 is actuated by operation of the keypad 16 or touch screen 18 as mentioned above. Once this occurs a signal is provided from a controller, microprocessor, microcontroller or other equivalent device in order to actuate or operate a motor of the lock 10. In other words, the motor is in operative communication with the controller, microprocessor, microcontroller or other equivalent device and the keypad 16 or touch screen 18 is in operative communication with the controller, microprocessor, microcontroller or other equivalent device such that inputs from the keypad or touch screen are provided to the controller, microprocessor, microcontroller or other equivalent device in order to actuate or operate a motor of the lock 10. In FIG. 4, the knob release mechanism 20 is in a locked position and the knob 12 is in a fully retracted knob position corresponding to the first position. In this position, the lock 10 cannot be unlocked as the knob 12 is not free to rotate in the direction of arrow 14. In accordance with an embodiment of the present disclosure, the knob release mechanism 20 includes a motor 22 for rotating a worm 24. The worm 24 is configured to engage teeth 26 of a primary arm 28, which is pivotally mounted to a carrier 30 for rotation about a pin 32. The knob release mechanism 20 also includes a secondary arm 34 pivotally mounted to the carrier 30 for rotation about pin 32. As mentioned above, operation of the motor 22 and thus the knob release mechanism 20 occurs via input of a correct combination into the keypad 16 or touch screen 18 of the lock 10.

FIG. 4 illustrates the primary arm 28 and the secondary arm 34 each in a first position. The primary arm 28 is spring biased into the first position by a spring 36 and the secondary arm 34 is spring biased into the first position by a spring 38.

Figure 5:
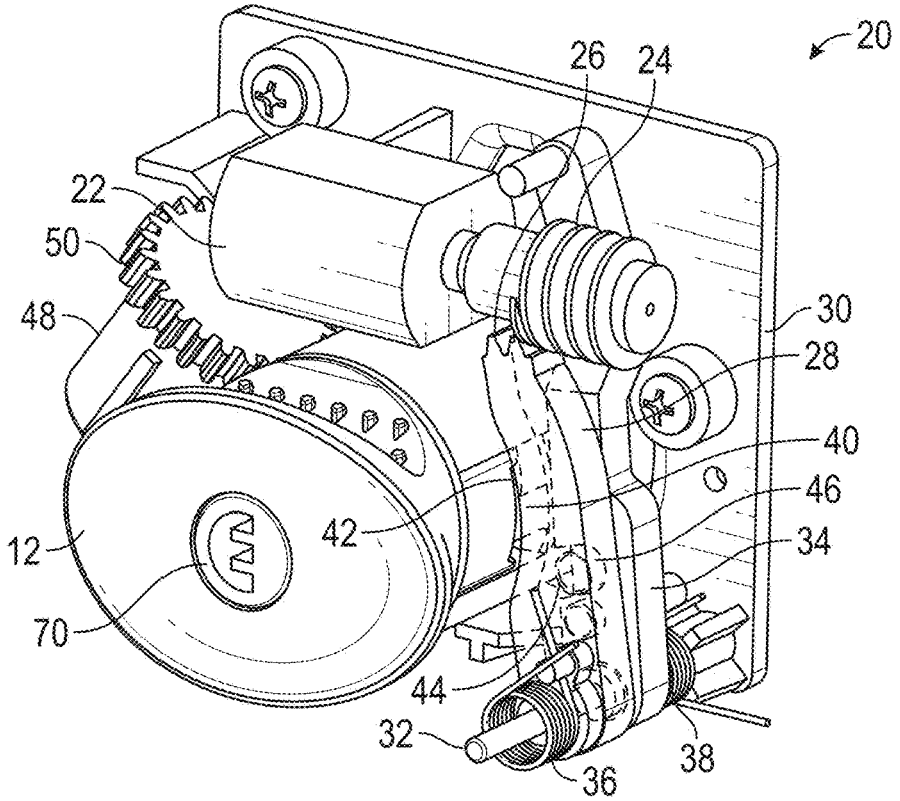

In FIG. 5, the primary arm 28 is shown in phantom illustrating a hook portion 40 of the secondary arm 34 that is received in a cavity 42 of the retractable knob 12 when the secondary arm 34 is in the first position in order to retain the retractable knob 12 in the retracted position. Also shown is that the primary arm 28 has a protrusion 44 that engages a slot 46 of the secondary arm 34.

Figure 6:
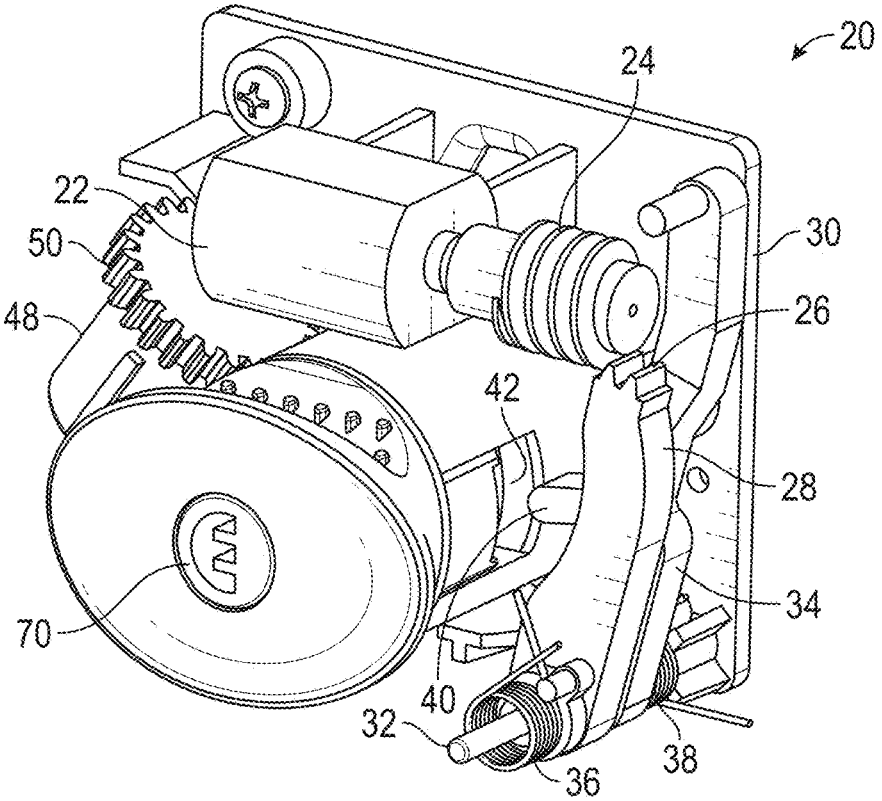
FIG. 6 is a perspective of the knob and knob release mechanism wherein the knob release mechanism has been activated.

In FIG. 6 the motor 22 has been activated due to the input of the correct combination to the keypad 16 or touchscreen 18 and the worm 24 has been rotated thereby pivoting the primary arm 28 and the secondary arm 34 into a second position wherein the hook portion 40 has been removed from the cavity 42 and the retractable knob is capable of moving from the retracted position to the extracted position shown at least in FIGS. 1B, 1C, 2B, 2C and 7-13.

Figure 7:
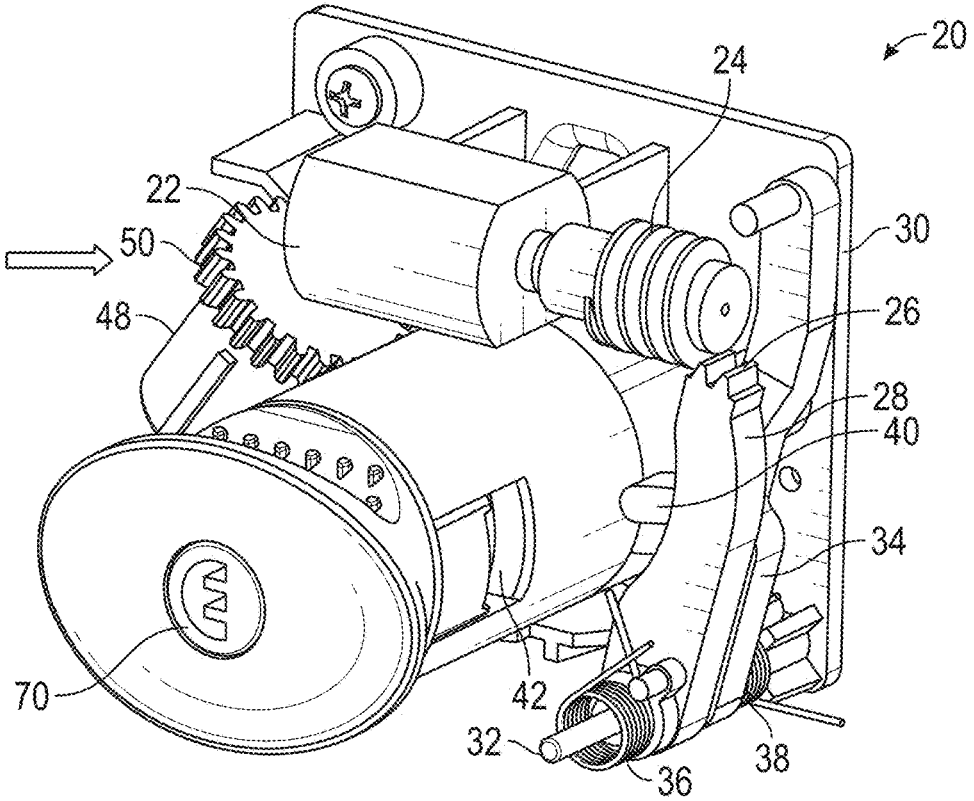
FIGS. 7 and 8 are perspective views of the knob and knob release mechanism wherein the knob release mechanism has been activated and the knob has been extended to an extended position or second position.
Figure 8:
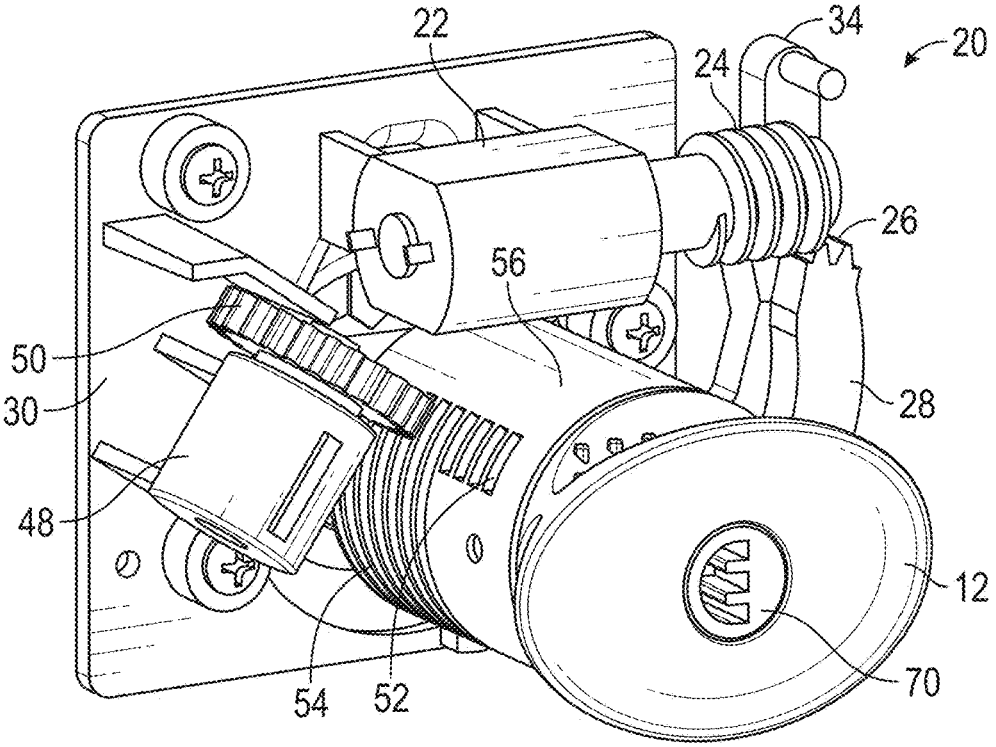

In FIGS. 7 and 8 the knob 12 has been extended to an extended or extracted position. Knob 12 is spring biased into the extracted or extended position by a spring 58 (FIG. 10) such that as the primary arm 28 and the secondary arm 34 are pivoted to their second positions, the knob 12 moves outwardly to its extended position.

The knob release mechanism 20 further comprises a damper 48 that slows or retards the movement of the knob 12 from the retracted to the extracted position. In other words, damper 48 slows the outward movement of the knob 12 due to the spring biasing force of spring 58. Damper 48 has a gear 50 that engages grooves 52 and 54 that are located on an exterior surface 56 of the knob 12. Accordingly, gear 50 rotates about its axis and provides a slowing force to the outward movement of knob 12. As is known in the related arts, the damper 48 may include a means such as a fluid or spring internal to the damper to provide resistance to the rotation of gear 50 about its axis as the knob 12 extends outwardly. As illustrated, the grooves 54 are longer radially than grooves 52 and grooves 52 are located towards the front of the knob 12 such that the knob 12 can only be rotated about its axis in the direction of arrow 14 to the third position when the knob 12 is in the extracted or extended position such that the teeth of gear 50 slide in grooves 54 as the knob is rotated.

Figure 9:
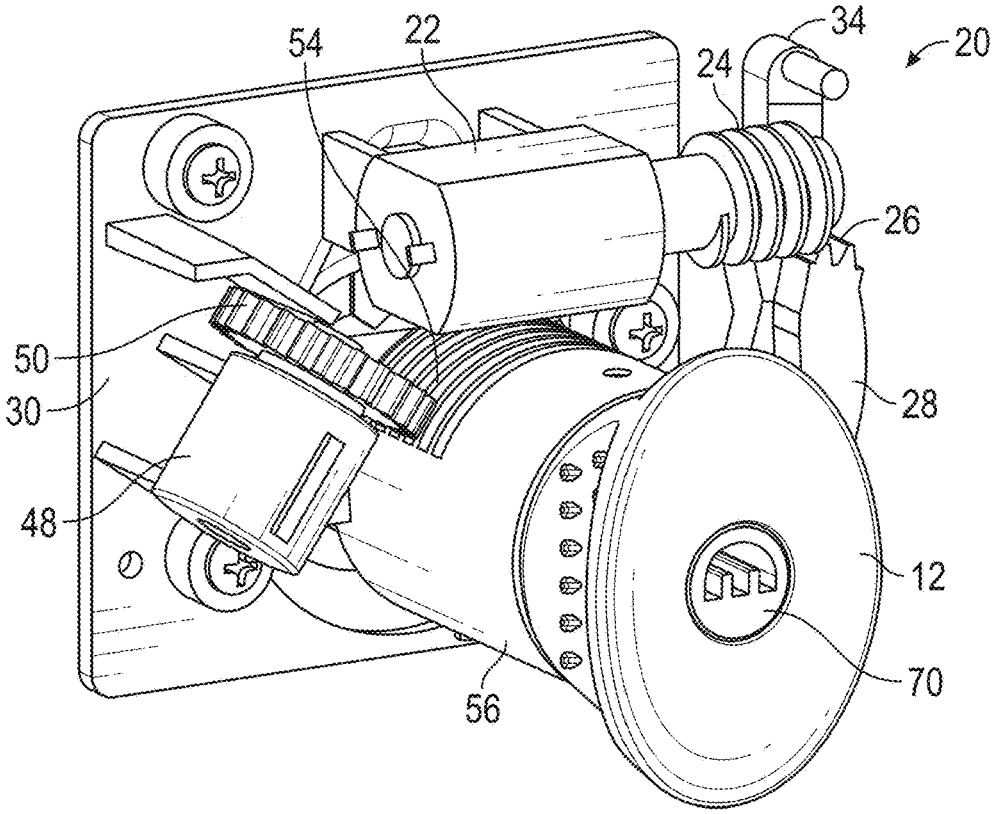
FIG. 9 is a perspective view of the knob and knob release mechanism wherein the knob release mechanism has been activated and the knob has been extended and rotated to a third position.

FIG. 9 is a perspective view of the knob 12 and knob release mechanism 20 wherein the knob release mechanism 20 has been activated and the knob 12 has been extended and rotated to the third position.

Figure 10:
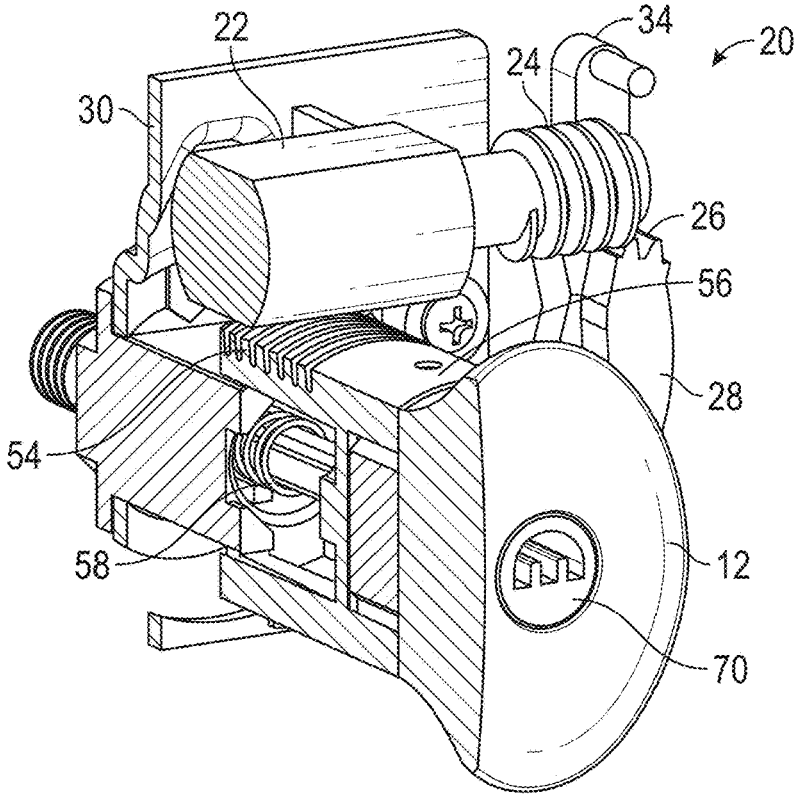
FIG. 10 is a partial cross-sectional view of the knob and knob release mechanism wherein the knob release mechanism has been activated and the knob has been extended and rotated to the third position.

FIG. 10 is a partial cross-sectional view of the knob 12 and knob release mechanism 20 wherein the knob release mechanism has been activated and the knob 12 has been extended and rotated to the third position. Also, illustrated is the spring 58 that biases the knob 12 into the second position.

Figure 11:
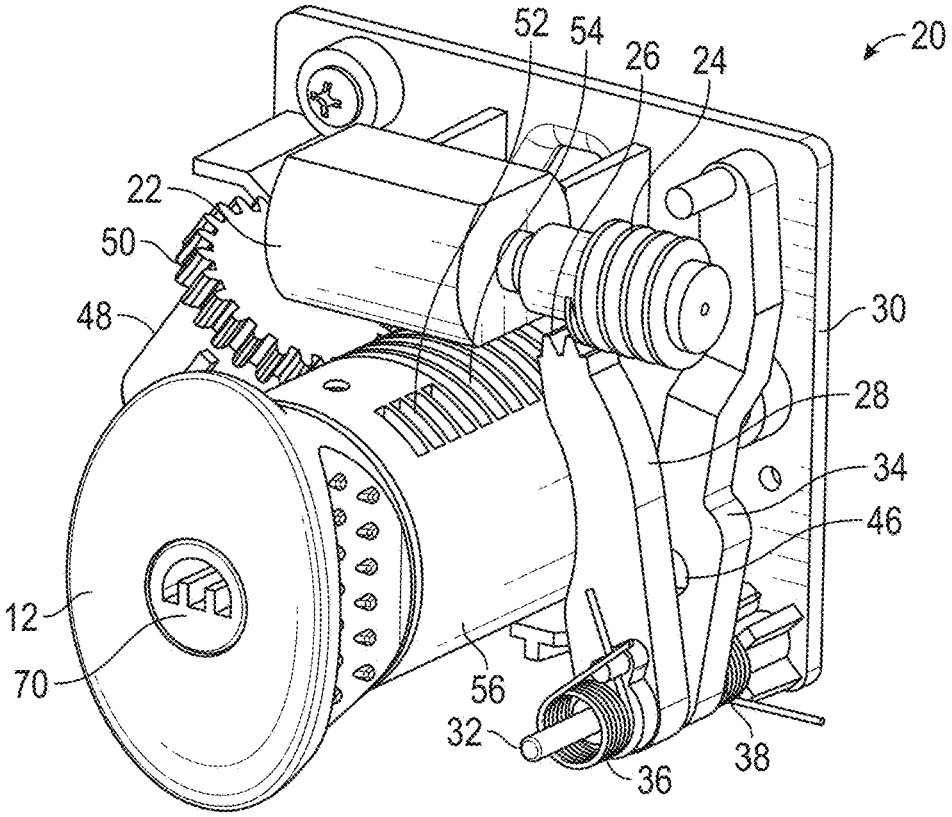
FIGS. 11 and 12 are perspective views of the knob and knob release mechanism wherein the knob has been extended and rotated and the knob release mechanism has activated for a subsequent locking event.
Figure 12:
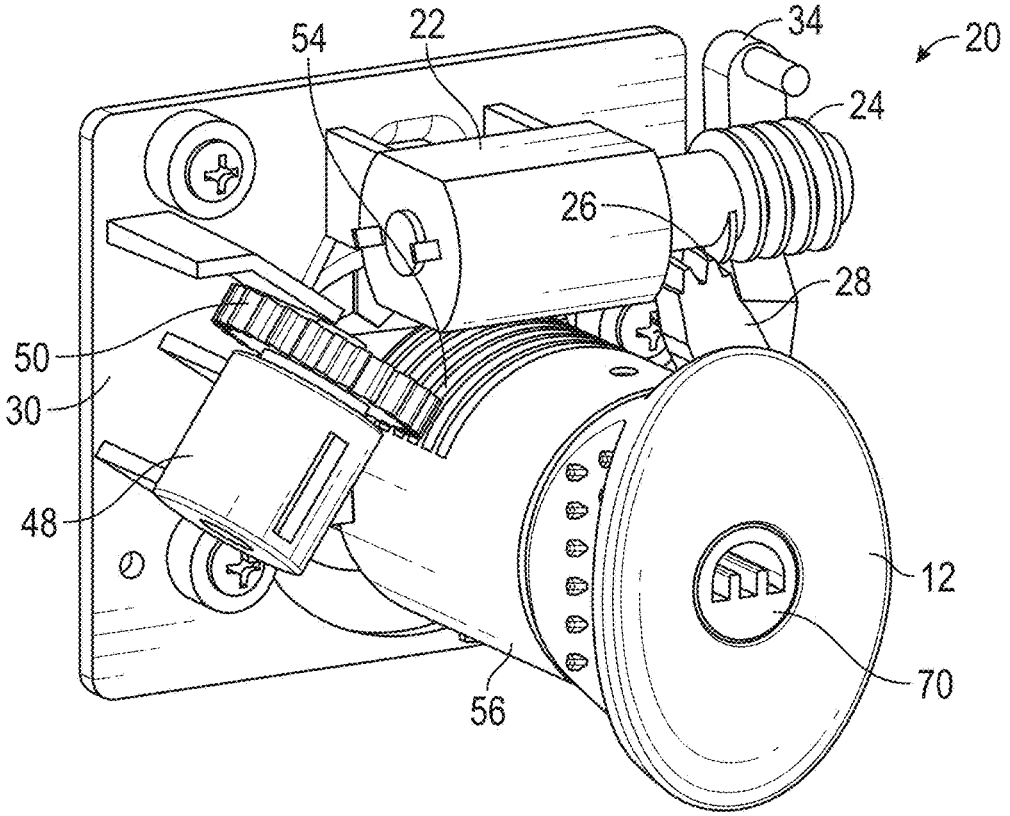

FIGS. 11 and 12 are perspective views of the knob 12 and knob release mechanism 20 wherein the knob 12 has been extended and rotated and the knob release mechanism has activated for a subsequent locking event. In these FIGS., the primary arm 28 has been moved into its first position while the secondary arm 34 remains in its second position.

Figure 13:
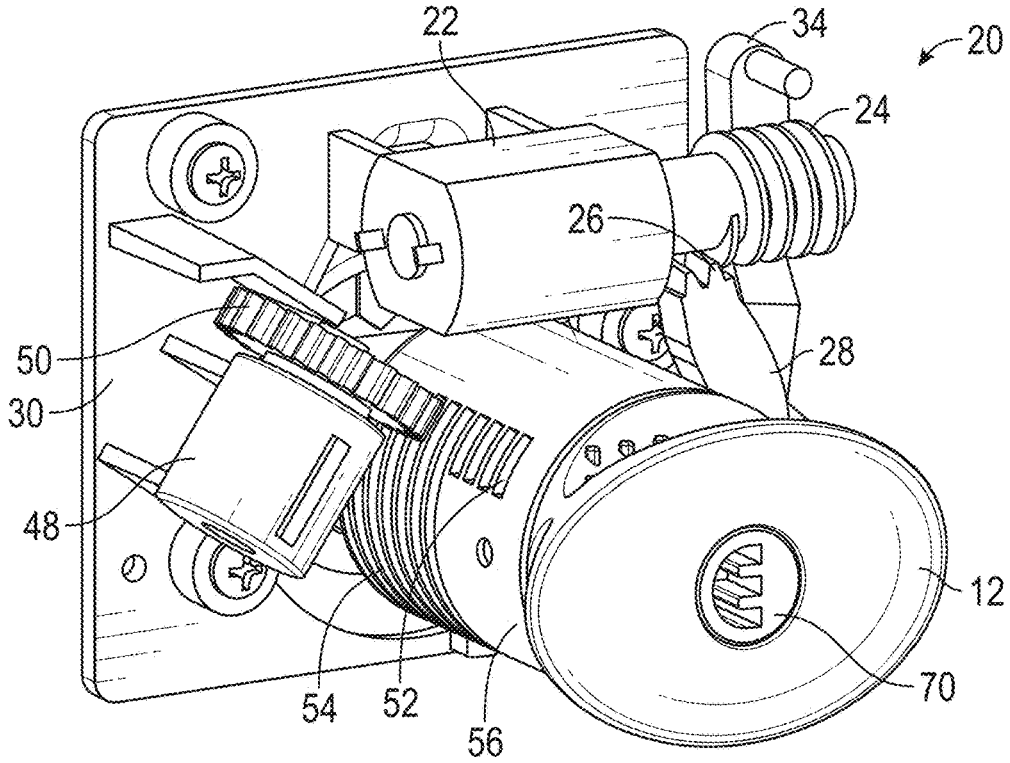
FIG. 13 is a perspective view of the knob and knob release mechanism wherein the knob is extended but has been rotated back to its second position.

In FIG. 13 the knob 12 is extended but has been rotated back to its second position.

Figure 14:
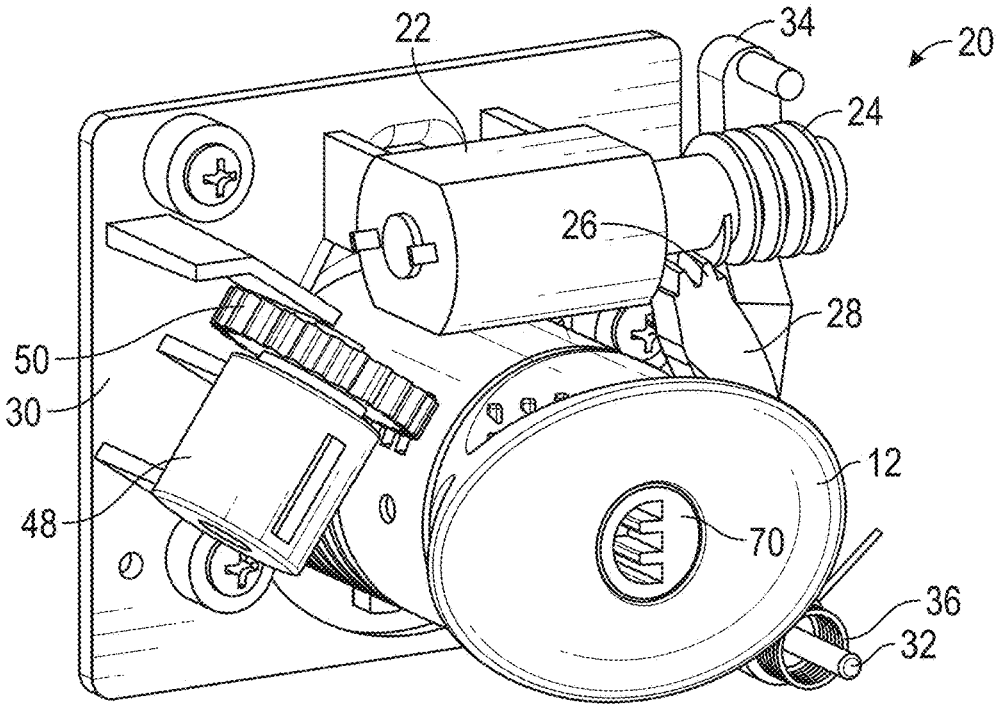
FIGS. 14-16 are perspective views of the knob and knob release mechanism wherein the knob release mechanism has been rotated back to its second position and pushed back into its retracted or first position.
Figure 15:
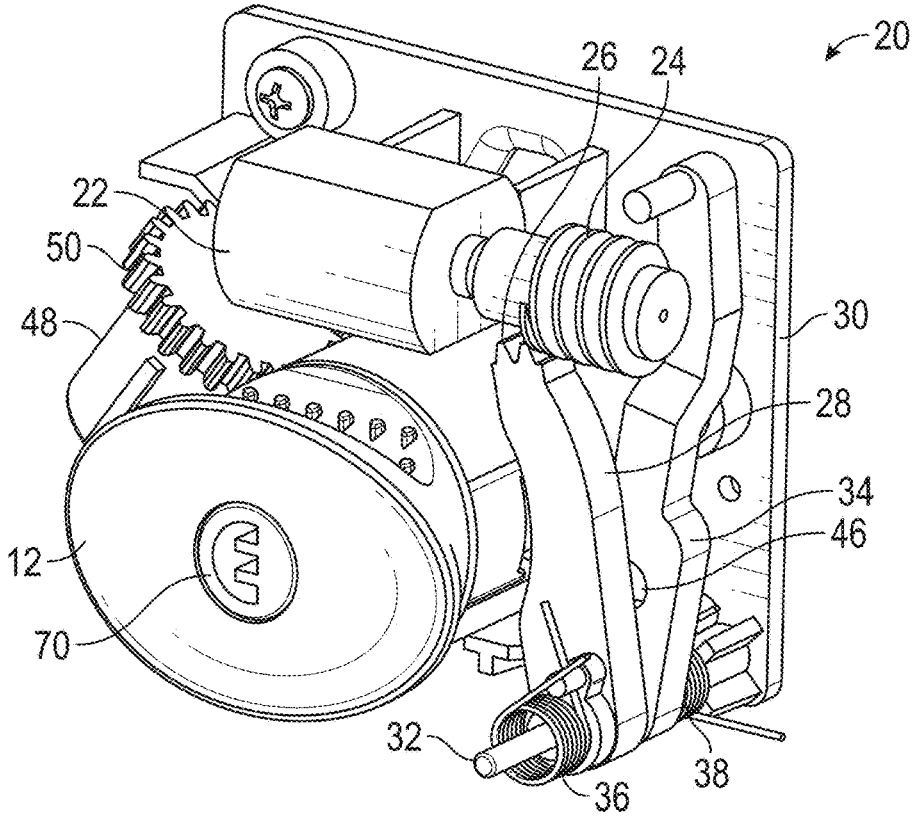
Figure 16:
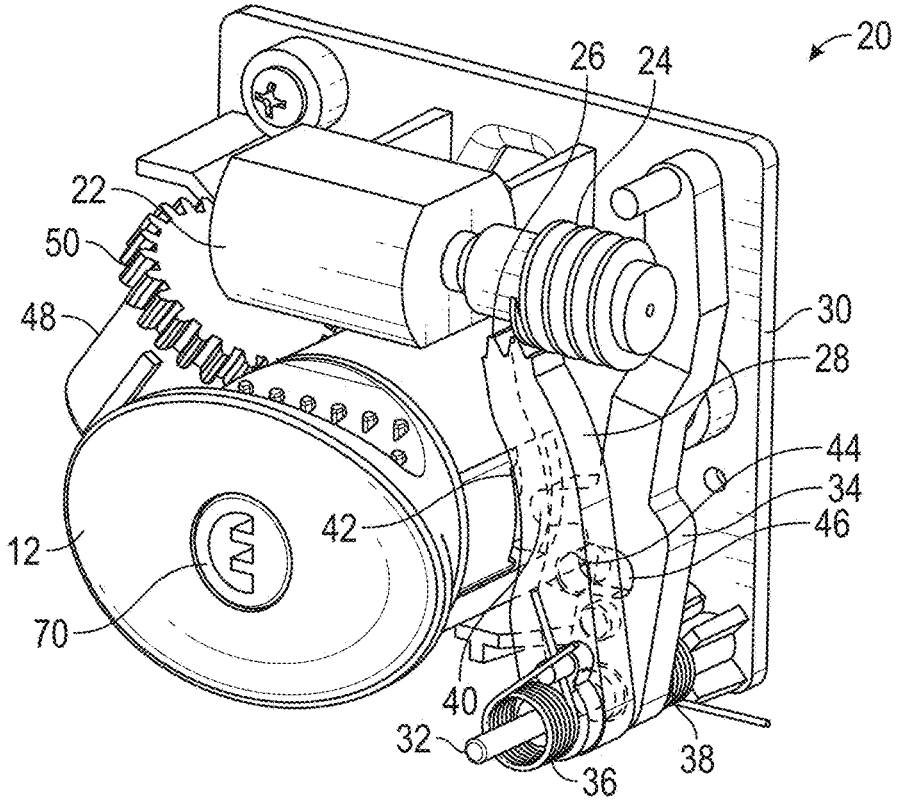

FIGS. 14-16 are perspective views of the knob 12 and the knob release mechanism 20 wherein the knob release mechanism 20 has been rotated back to its second position and pushed back into its first or retracted position.

Figure 17:
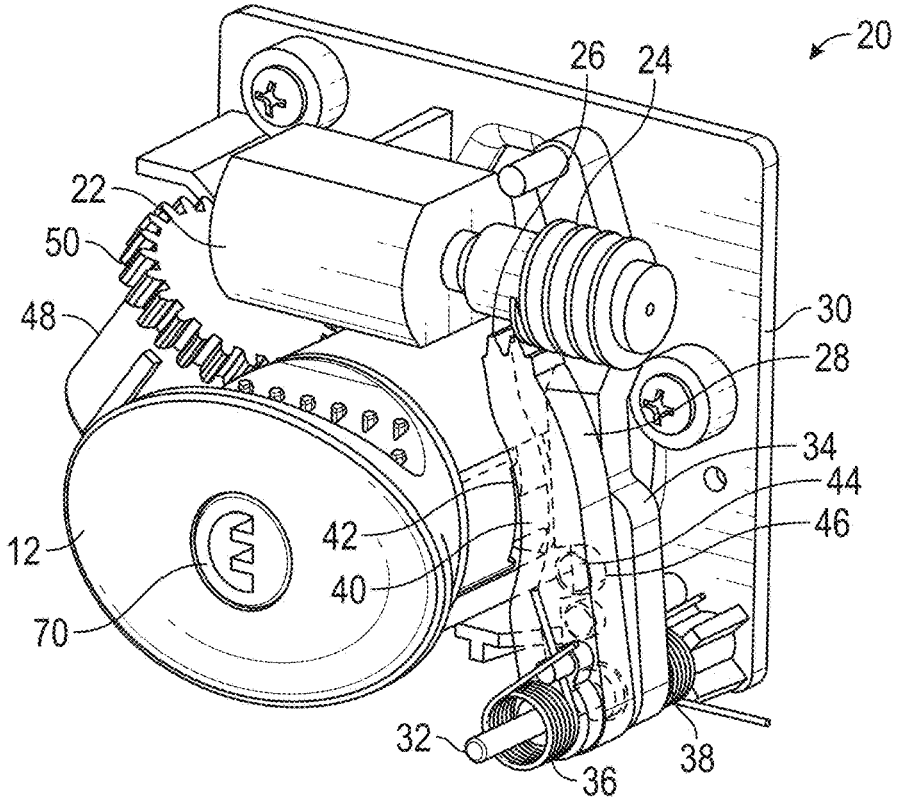
FIGS. 17 and 18 are perspective views of the knob and knob release mechanism wherein the knob release mechanism has been rotated back to its second position and pushed back into its retracted or first position.
Figure 18:
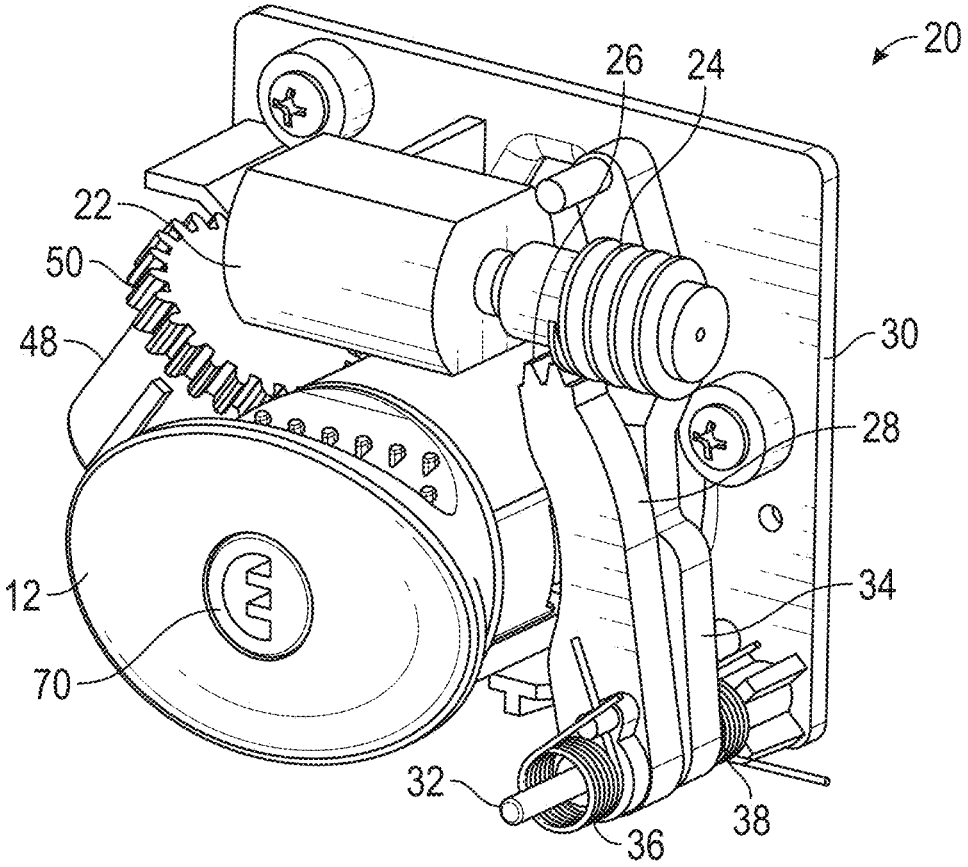

FIGS. 17 and 18 are perspective views of the knob 12 and knob release mechanism 20 wherein the knob 12 has been rotated back to its second position and pushed back into its retracted position or first position. When this occurs, the hook 40 of the secondary arm 34 is pivoted into its first position by spring 38 and the knob 12 is retained in the retracted position against the biasing force of spring 38.

In accordance with various embodiments of the present disclosure operation of the motor 22 is caused by providing the proper combination to the lock 10 via other keypad 16 or touch screen 18. Once this combination is provided the motor is operated and the primary and secondary arms are rotated from their first positions to their second positions so that the knob 12 can be spring biased from its first position to its second position. As mentioned above, the damper 48 via gear 50 slows the outward movement of the knob 12. Once the knob 12 is in its second position the teeth of the gear 50 are free to slide in grooves 54.

In one embodiment, the lock 10 may also comprise a manual release or override via a key which is inserted into a master key cylinder 70, which when turned will contact hook 40 of the secondary arm 34 and will rotate at least the secondary arm 34 from its first position to its second position so that the knob 12 can be extracted from its first position to its second position.

Figure 19:
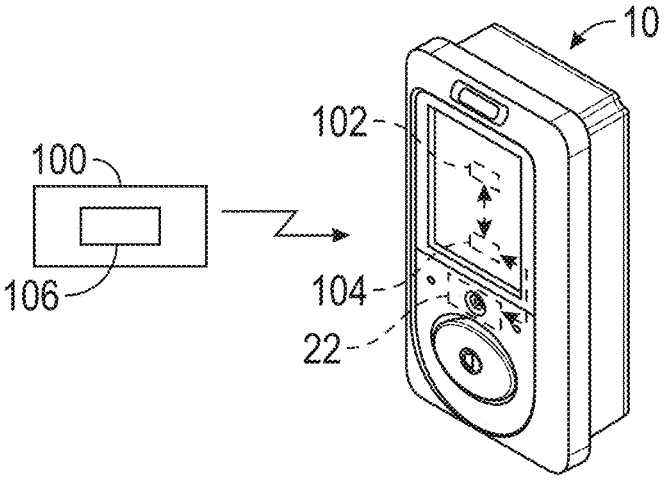
FIG. 19 illustrates an alternative embodiment of the present disclosure.

In another embodiment and as illustrated schematically in FIG. 19, the motor 22 is energized via wireless communication (e.g., Bluetooth, WiFi, RFID, etc. or any other equivalent communication) with a key FOB, wireless key or other equivalent device 100 that communicates wirelessly with a receiver or receiver/transmitter 102 in operable communication with a microprocessor 104 or other equivalent device or the receiver/transmitter 102 directly communicates with the motor 22. Accordingly and when the key FOB or other equivalent device 100 is within range of the receiver or receiver/transmitter 102 a transmitter 106 of the key FOB or other equivalent device 100 provides an actuation code to the motor 22 and the motor 22 is actuated in order to allow the knob 12 extend from the lock 10 as described above.

The term "about" is intended to include the degree of error associated with measurement of the particular quantity based upon the equipment available at the time of filing the application. For example, "about" can include a range of ±8% or 5%, or 2% of a given value.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A lock, comprising:

a retractable knob; and a knob release mechanism for retaining the retractable knob in a retracted position, the knob release mechanism retains the retractable knob in the retracted position until a motor of the knob release mechanism is actuated by an input provided to a keypad located on a surface of the lock wherein movement of the retractable knob from the retracted position to an extended position is dampened by a damper, wherein the retractable knob is spring biased into the extended position.

2. The lock as in claim 1, wherein the knob release mechanism includes the damper and the damper is provided with a gear that is slidably received within a set of grooves located in the retractable knob, and wherein the gear prevents rotation of the retractable knob unless the retractable knob is in the extended position.

3. The lock as in claim 1, wherein the knob release mechanism further comprises a primary arm and a secondary arm, wherein the secondary arm is configured to retain the retractable knob in the retracted position.

4. The lock as in claim 1, wherein the knob release mechanism further comprises a primary arm pivotally mounted to the knob release mechanism for movement between a first position and a second position and a secondary arm pivotally mounted to the knob release mechanism for movement between a first position and a second position, wherein the secondary arm is configured to retain the retractable knob in the retracted position when the secondary arm is in the first position.

5. The lock as in claim 4, wherein the motor when actuated pivots the secondary arm into the second position.

6. A lock, comprising:

a retractable knob; and a knob release mechanism for retaining the retractable knob in a retracted position, the knob release mechanism retains the retractable knob in the retracted position until a motor of the knob release mechanism is actuated by an input provided to a keypad located on a surface of the lock, the knob release mechanism including a primary arm pivotally mounted to the knob release mechanism for movement between a first position and a second position and a secondary arm pivotally mounted to the knob release mechanism for movement between a first position and a second position, wherein the secondary arm is configured to retain the retractable knob in the retracted position when the secondary arm is in the first position, and wherein the motor further comprises a worm and the worm pivots the primary arm by engaging teeth of the primary arm.

7. The lock as in claim 2, wherein the set of grooves further comprises a first set of grooves and a second set of grooves, the second set of grooves having a greater length than the first set of grooves, wherein the first set of grooves are closer to a forward surface of the retractable knob.

8. The lock as in claim 7, wherein the knob release mechanism further comprises a primary arm pivotally mounted to the knob release mechanism for movement between a first position and a second position and a secondary arm pivotally mounted to the knob release mechanism for movement between a first position and a second position, wherein the secondary arm is configured to retain the retractable knob in the retracted position when the secondary arm is in the first position.

9. The lock as in claim 1, wherein the knob release mechanism further comprises a primary arm pivotally mounted to the knob release mechanism for movement between a first position and a second position and a secondary arm pivotally mounted to the knob release mechanism for movement between a first position and a second position, wherein the secondary arm has a hook portion that is received in a cavity of the retractable knob when the retractable knob is in the retracted position and the secondary arm is in the first position.

10. The lock as in claim 1, wherein the knob release mechanism further comprises a primary arm and a secondary arm, wherein the secondary arm is configured to retain the retractable knob in the retracted position and the primary arm has a protrusion configured to engage a slot of the secondary arm.

11. The lock as in claim 2, wherein the set of grooves are located in an exterior surface of the retractable knob.

12. A method releasing a retractable knob of a lock, comprising:

spring biasing the retractable knob into an extended position;

retaining the retractable knob in a retracted position by a knob release mechanism;

releasing the retractable knob from the retracted position by actuating the knob release mechanism through an input provided to the lock; and damping movement of the retractable knob from the retracted position to the extended position with a damper.

13. The method as in claim 12, wherein the damper further comprises a gear that is slidably received within a set of grooves located in the retractable knob.

14. The method as in claim 13, further comprising preventing rotation of the retractable knob unless the retractable knob is in the extended position, and wherein rotation of the retractable knob is prevented by the gear.

15. The method as in claim 13, wherein the set of grooves further comprises a first set of grooves and a second set of grooves, the second set of grooves having a greater length than the first set of grooves, wherein the first set of grooves are closer to a forward surface of the retractable knob.

16. The method as in claim 12, wherein the input is provided to a keypad or touch screen located on a surface of the lock.

17. A lock system, comprising:

a lock, comprising:

a retractable knob;

a knob release mechanism for retaining the retractable knob in a retracted position, the knob release mechanism retaining the retractable knob in a retracted position until a motor of the knob release mechanism is actuated;

a receiver configured to receive wireless transmissions, the receiver being in operable communication with the motor;

a wireless key that communicates wirelessly with the receiver; and a microprocessor in operable communication with the motor and the receiver and wherein the knob release mechanism includes a damper that dampens movement of the retractable knob from the retracted position to an extended position, wherein the retractable knob is spring biased into the extended position.

18. The lock system as in claim 17, wherein the damper includes a gear that is slidably received within a set of grooves located in the retractable knob, and the gear prevents rotation of the retractable knob unless the retractable knob is in an extended position.

* * * * *